United States Patent [19]

Sakamaki

[11] 4,388,040

[45] Jun. 14, 1983

[54] ROTARY FLUID PUMP

[75] Inventor: Hiroshi Sakamaki, Utsunomiya, Japan

[73] Assignee: Nippon Piston Ring Co., Ltd., Tokyo, Japan

[21] Appl. No.: 212,960

[22] Filed: Dec. 4, 1980

[30] Foreign Application Priority Data

Dec. 14, 1979 [JP] Japan ..... 54-172389[U]
Dec. 14, 1979 [JP] Japan ..... 54-172392[U]

[51] Int. Cl.[3] ..... F03B 11/00; F04D 29/04
[52] U.S. Cl. ..... 415/174; 308/189 A
[58] Field of Search ..... 415/174, 170 A, 170 R, 415/173 A, 171; 308/189 A, 189 R, 239

[56] References Cited

U.S. PATENT DOCUMENTS

| | | | |
|---|---|---|---|
| 2,833,465 | 5/1958 | Cable | 230/152 |
| 2,957,711 | 10/1960 | Aspelin | 415/170 A |
| 3,191,852 | 6/1965 | Gaatz et al. | 230/152 |
| 3,193,190 | 7/1965 | Lindberg | 230/152 |
| 3,402,671 | 9/1968 | Wilfley | 415/170 A |
| 3,485,178 | 12/1969 | Dutton | 415/174 |
| 3,738,714 | 6/1973 | Langner | 308/189 A |
| 3,807,815 | 4/1974 | Kasabian | 308/189 A |
| 4,050,855 | 9/1977 | Sakamaki et al. | 418/131 |

FOREIGN PATENT DOCUMENTS

| | | |
|---|---|---|
| 47-18211 | 6/1972 | Japan . |
| 54-20485 | 7/1979 | Japan . |

*Primary Examiner*—Robert W. Jenkins
*Attorney, Agent, or Firm*—Sughrue, Mion, Zinn, Macpeak & Seas

[57] ABSTRACT

A rotary fluid pump in which thermal seizure and wearing due to thermal expansion are substantially eliminated. The rotary shaft of the compressor is coupled to a front housing through bearing means composed of two ball bearings each having inner and outer races. The widths of one of the inner or outer races of both the bearings are reduced at first sides thereof with the reduced sides confronting each other. First and second retainer rings are provided abutting, respectively, the inner and outer races to push the farther sides of the inner and outer races against a stepped portion formed on the rotary shaft. Soft material can be provided on one or both of the sides of the rotor and/or the circumferential surface of the rotor so that the rotor abuts the front housing and the rear housing through the soft material and/or the circumferential surface of the rotor abuts an inner surface of the center housing.

11 Claims, 5 Drawing Figures

ROTARY FLUID PUMP

BACKGROUND OF THE INVENTION

The present invention relates to rotary fluid pumps. More particularly, the invention relates to a rotary fluid pump which is free from adverse effects due to thermal expansion, easy to assemble, and which has a high volumetric coefficient.

When a conventional rotary fluid pump as shown in FIG. 1 is employed as a coolant compressor, its temperature during ordinary use will increase to a high value, typically 100° to 150° C., and therefore its internal components are unavoidably subjected to thermal expansion. Especially, it is desirable that the gaps 42 and 92 between the rotor 2 and the front housing 4 and between the rotor 2 and the rear housing 9 be as small as possible to improve the volumetric coefficient. However, if the gaps are made small, then the front and rear housings 4 and 9 are strongly pressed against the rotor 2 upon thermal expansion due to the normal temperature increase as a result of which the rotor may be thermally seized against the housings.

In order to protect the rotor 2 and the front and rear housings 4 and 9 from wear and seizure, heretofore the pump was so designed that the rotor 2 is axially movable and lubricating oil is applied to the gaps 42 and 92. In another construction, the pump was so designed that the sides of the rotor 2 are abutted against flexible plates, or the sides of the rotor 2 are covered with a self-lubricating material. However, these conventional pumps are disadvantageous in the following points. In the pumps using lubricating oil, the pump is intricate in construction and bulky in size. In the pump in which the sides of the rotor are covered with self-lubricating material, the rotor may be locally worn or the coating of self-lubricating material applied to the sides of the rotor may be worn away as a result of which the clearances provided by the gaps 42 and 92 are excessively increased.

SUMMARY OF THE INVENTION

Accordingly, an object of the present invention is to eliminate the above-described difficulties accompanying a conventional rotary fluid pump.

This, as well as other objects of the invention, is met by a rotary fluid pump including a rotary shaft, a front housing, a center housing, a rear housing, and a rotor having vanes. The rotor is adapted to be rotated by the rotary shaft in a space defined by the front housing, the center housing, and the rear housing. The rotary shaft is rotatably supported at both ends thereof. The rotary shaft is coupled to the front housing through bearing means composed of two ball bearings each of which has an inner race and an outer race. The width (the length in the axial direction) of one of the inner races and the outer races is reduced at first ends thereof. That is, either the inner races of both bearings are reduced at first ends thereof or both outer races are reduced at first ends therof. The bearing means includes means for fixedly securing the inner races to the rotary shaft by tightening the inner races from both sides in the axial direction thereof and means for fixedly securing the outer races to the front housing by tightening the outer races from both sides in the axial direction. The two ball bearings are tightened with the sides of the reduced one of the inner and outer races of both bearings confronting each other. With this construction, axial displacement of the rotor and rotary shaft are prevented when a thrust force is applied thereto. First and second retainer rings may be provided with the inner races of the ball bearings being secured to the rotary shaft with the first retainer ring and the outer races being fixedly secured to the front housing with the second retainer ring. The first retainer ring is fitted over the rotary shaft either by press fitting or screwing such that a second end of one of the inner races abuts against a stepped portion of the rotary shaft and a second end of the inner race abuts against the first retainer ring. The second retainer ring is coupled to the front housing by either press fitting or screwing such that one of the outer races abuts against a stepped portion of the front housing and the outer race abuts against the second retainer ring.

There is further preferably provided a mechanical seal having a case ring. The case ring abuts the first retainer ring which tightens the inner races of the ball bearings but not the second retainer ring which tightens the outer races of the ball bearings. There may be further provided a layer of soft material coated on at least the side of the rotor which is farther from the bearing means and an inner surface of the rear housing which confronts the side of the rotor. This causes the rear housing and the rotor to be separated from one another by the soft material without the formation of a gap therebetween. Otherwise, the soft material can be provided on one of both sides of the rotor and the circumferential surface of the rotor whereby at least one of the rotor abutting the front housing and the rear housing through the soft material and the circumferential surface of the rotor abutting an inner surface of the center housing occurs.

The nature, principle and utility of the invention will become more apparent from the following detailed description and the appended claims when read in conjunction with the accompanying drawings.

DESCRIPTION OF THE PREFERRED EMBODIMENTS

Figure 1:
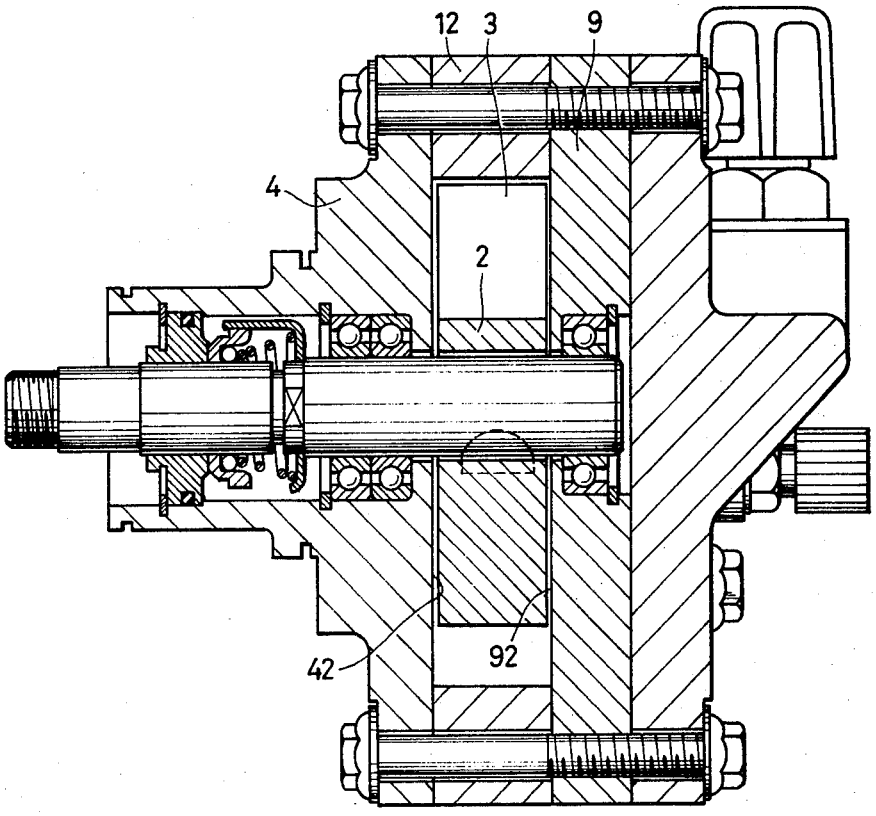
FIG. 1 is a sectional view showing a conventional rotary fluid pump.
Figure 2:
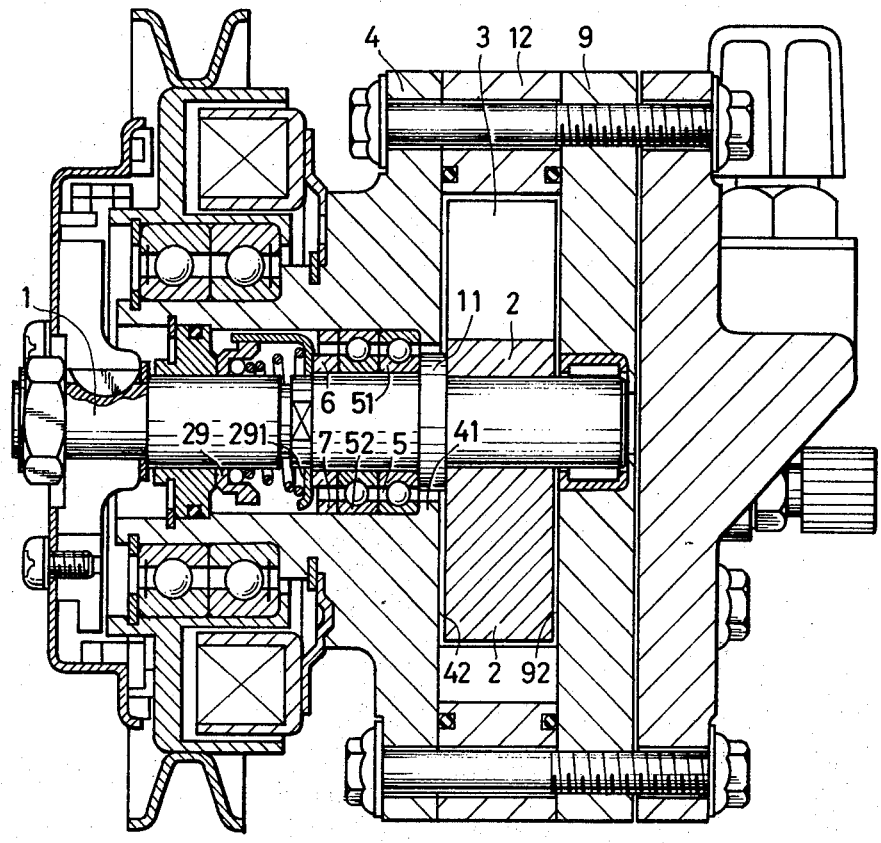
FIG. 2 is a sectional view showing a first preferred embodiment of a rotary fluid pump according to the invention.

A first embodiment of a rotary fluid pump constructed according to the invention is as shown in FIG. 2.

In the rotary fluid pump shown in FIG. 2, a rotary shaft 1 is coupled through ball bearings 5 to a front housing 4. More specifically, inner races 51 of the bearings 5 are secured to the rotary shaft 1 by tightening from both sides in the axial direction thereof while outer races 52 are secured to the front housing 4 by tightening in the same manner.

Furthermore, the bearings 5 are subjected to pre-pressure in the axial direction so that when a thrust force is imparted to the bearings in the axial direction they will not be displaced. As a result, axial play of the rotary shaft 1 relative to the front housing 4 is completely eliminated.

A rotor 2 is fixedly secured to the rotary shaft 1 be press fitting or shrink fitting so that the rotor 2 cannot be displaced with respect to the rotary shaft 1.

The rotary fluid pump thus constructed will be described in more detail.

In order to fixedly secure the inner races 51 of the bearings 5 to the rotary shaft 1, a first one of the inner races 51 is abutted against a stepped portion 11 of the rotary shaft 1 after which a retainer ring 6 is set on the other inner race by press fitting or by screwing it on. In this case, the technique of setting the retainer ring 6 on the inner race by press fitting is preferable. In order to fixedly secure the outer races 52 to the front housing 4, a first one of the outer races 52 of the bearing 5 is abutted against the stepped portion 41 of the front housing 4 and then a retainer ring 7 is set on the other outer race 52 by press fitting.

Relative play of the front housing 4 and the rotary shaft 1 is completely eliminated by tightening the bearings 5 with the retainer rings 6 and 7 as described above.

Figure 3:
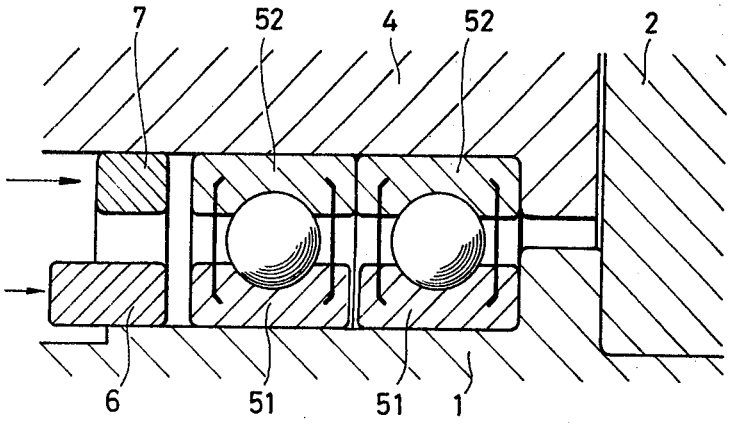
FIG. 3 is an enlarged view showing the bearing structure and related components in the pump shown in FIG. 2 prior to assembly.

If the following construction is employed, even if a thrust force is applied to the bearings, the bearings will not be displaced. That is, two bearings are constructed such that the width (the length in the axial direction) of one of the outer or inner race of each of the two bearings is reduced on one side. The two bearings are fixedly secured to the rotary shaft and the front housing in such a manner that they are tightened with the reduced sides confronting each other and the bearings are subjected to axial pre-pressure. More specifically, as shown in FIG. 3, the width of a predetermined one of the inner race 51 or the outer race 52 (the inner race 51 as shown in FIG. 3) of both of the two ball bearings is reduced so that a very small gap is provided between the adjacent sides of the predetermined two inner races or outer races. The inner and outer races are fixedly secured by tightening them with the retainer rings 6 and 7 in the axial direction as a result of which the small gap is decreased so that the ball bearings are subjected to an axial pre-pressure corresponding to the amount of reduction of the predetermined ones of the races. Thus, even when a thrust force is imparted to the rotary shaft, no movement of the shaft relative to the front housing results.

Angular-contact bearings may be employed for the bearings 5 if desired.

Following the assembly of the bearings into the front housing 4, the rotor 2 is fixedly secured to the rotary shaft 1 by press fitting, shrink fitting or welding in such a manner that the rotor 2 is in close contact with the stepped portion 11 of the rotary shaft 1. That is, the rotor 2 and the rotary shaft 1 form a single unit so far as rotational and axial motions are concerned.

As is apparent from the above description, relative axial play of the rotary shaft 1 and the front housing 4 is eliminated as is relative axial play of the rotor 2 and the rotary shaft 1 according to the invention. Therefore, the clearance provided by the gap 42 between the front housing 4 and the rotor 2 is not changed by the thrust force. Furthermore, the distance between the bearing 5 and the gap 42 is extremely short and the effect of thermal expansion is considerably low. Thus, a clearance value set during the initial assembly is stably maintained unchanged for the gap 42, and accordingly the gap 42 will not close up and hence will not cause thermal seizure and not decrease the pumping efficiency.

Moreover, the gap 92 between the rotor 2 and the rear housing 9 will not close up and cause thermal seizure and pumping efficiency decrease if the axial play of the rotor 2 relative to the rear housing is eliminated and if a minimum value is provided for the clearance provided by the gap 92 taking thermal expansion into account.

Similarly as in an ordinary pump, a mechanical seal 29 is provided on the input side of the rotary shaft 1. In this connection, the case ring 291 of the mechanical seal 29 is abutted against the retainer ring 6 holding the inner races 51 of the bearings but not against the retainer ring 7 holding the outer races 52 so as to prevent thermal seizure of the case ring 291 and the retainer ring 7.

Furthermore, according to the invention, clearance variations due to the effects of thermal expansion are prevented and the volumetric coefficient is further improved. This will be described with reference to FIG. 4.

Figure 4:
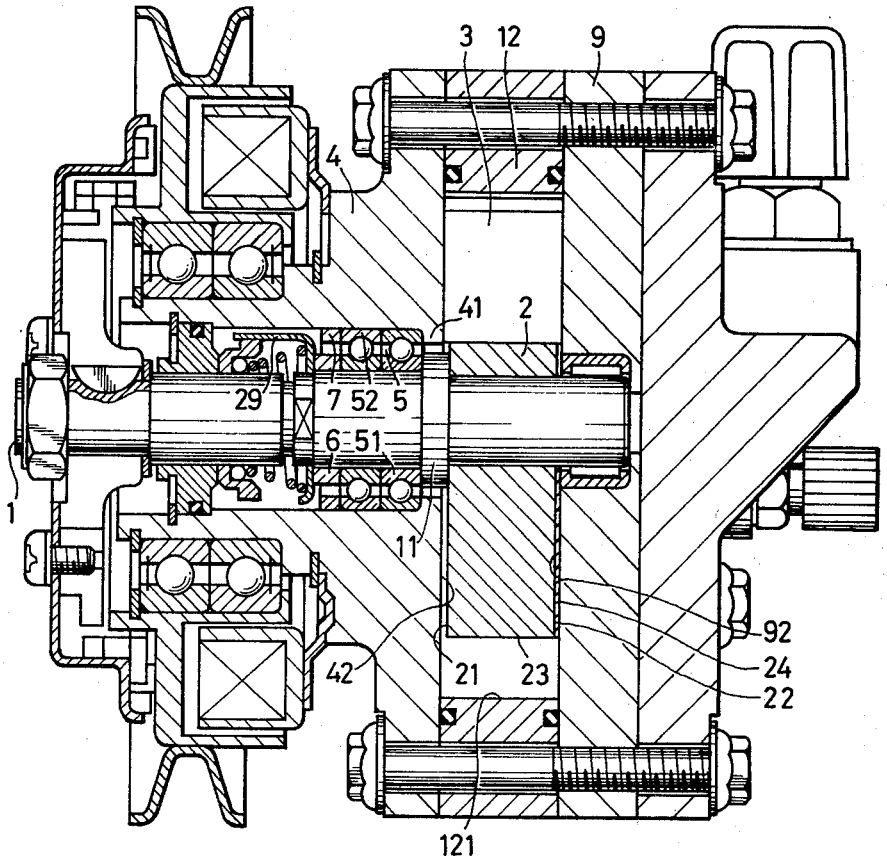
FIG. 4 is a sectional view showing a second preferred embodiment of a rotary fluid pump according to the invention.

In the pump shown in FIG. 4, the one side 22 of the rotor 2 which is farther from the bearing 5, or the inner surface of the rear housing 9 which confronts the side, 22 is covered with a soft material 24. Alternatively, the soft material 24 can be bonded to the side 22 or the inner surface of the rear housing 9. In either case, there is no gap left between the rear housing 9 and the rotor 2 because of the presence of the soft material 24. This will be described in more detail.

In order to fixedly secure the inner races 51 of the bearings 5 to the rotary shaft 1, first, similar to the above-described case in which an inner race 51 is abutted against the stepped portion 11 of the rotary shaft, the retainer ring 6 is set on the other inner race 51 by press fitting or by screwing it on. Thereafter, in order to fixedly secure the outer races 52 to the front housing 4, one of the outer races 52 is abutted against the stepped portion 41 after which the retainer ring 7 is inserted into the front housing 4 by press fitting to tighten the outer races 52. Axial play of the rotary shaft 1 relative to the front housing 4 is completely eliminated by tightening the bearing 5 with the retainer rings 6 and 7.

Similar to the above-described case, even when a thrust force is applied to the bearings, the bearings will not be displaced. That is, two bearings are constructed with the width (or the length in the axial direction) of a predetermined one of the outer or inner race of both of the two bearings reduced at one side. The two bearings are fixedly secured to the rotary shaft and the front housing by tightening them with the reduced sides confronting each other and the bearings are subjected to axial pre-pressure.

Then, the rotor 2 is fixedly secured to the rotary shaft 1 by press fitting, shrink fitting or welding in such a manner that the rotor 2 is in close contact with the stepped portion 11 of the rotary shaft 1. That is, the rotor 2 and the rotary shaft from a single unit so far as rotational and axial motions are concerned.

The clearance provided by the gap 92 between the one side 22 of the rotor 2 which is farther from the bearings 5 and the rear bearing 9 is not affected when a thrust force is applied thereto although it is affected by thermal expansion. In accordance with the invention, the side 22 of the rotor 2 or the inner surface of the rear housing 9 which confronts the side 22 is covered with a soft material 24. Alternatively, the soft material 24 can be bonded to the side 2 or the inner surface. In either case, the rotor 2 is in contact with the rear housing 9 through the soft material 24. As a result, the following effects are obtained. That is, when the rotor 2 is strongly pushed by the rear housing 9 as the temperature increases, only the soft material 24 is worn and therefore no thermal seizure occurs. Furthermore, the amount of wear does not exceed the minimum clearance between the rotor 2 and the rear housing and accordingly the volumetric coefficient is not decreased. This is due to the fact that the rotor 2 and the rear housing 9 are coupled through the bearings 5 in the axial direction.

Thus, the rotary fluid pump according to the invention is improved in volumetric coefficient, free from thermal seizure and is easy to assemble because it is unnecessary to carefully adjust a very small clearance. Furthermore, the ease of assembly and volumetric coefficient of the rotary fluid pump can be further improved by covering both sides 21 and 22 of the rotor 2 with soft material 24 by bonding soft material 24 to the two sides 21 and 22 in such a manner that the rotor 2 abuts the front housing 4 and the rear housing 9 either without gaps therebetween or through the soft material.

Of course, it is possible to apply the soft material to the inner surface of the front housing 4 and the inner surface of the rear housing 9 and/or the inner surface of a center housing 12. However, in the case where the vanes of the pump are made of a carbon material and the soft material is a resin material, the soft material may become molten and stick to the vanes. Therefore, it is preferable that the soft material be applied to the rotor only.

In the rotary fluid pump of the invention, the soft material 24 is preferably tetrafluoroethylene although molybdenum disufide and soft metal may be employed.

Figure 5:
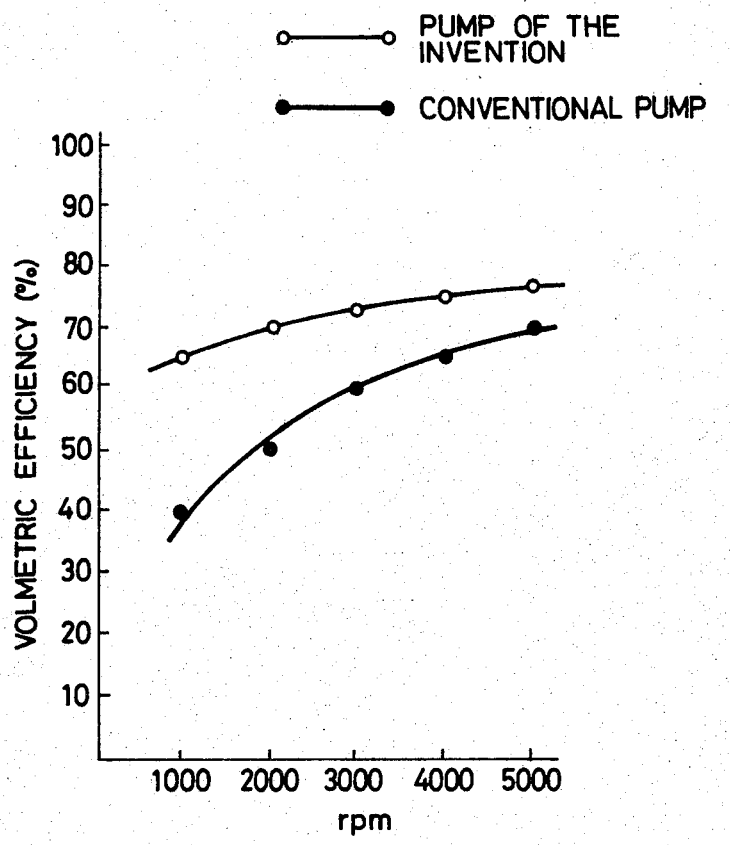
FIG. 5 is a graphical representation indicating a comparison of the efficiency of the rotary fluid pump of the invention with that of a conventional rotary fluid pump.

In order to demonstrate the improved effects of the rotary fluid pump according to the invention, comparisons were carried out between the volumetric coefficient of the rotary fluid pump of the invention and that of a conventional rotary fluid pump. The results are shown graphically in FIG. 5. It has been found through experiments peformed on these pumps used as coolant compressors that the volumetric coefficient of the pump of the invention is higher by about 50% than that of the conventional pump. This means that, in the pump of the invention, the axial displacements of the front housing, the rotor and the rear housings have been eliminated and the clearances provided by the gaps 42 and 92 are maintained at a minimum.

Furthermore, it can be readily appreciated that the ease of assembly and the volumetric coefficient of the pump of the invention can further be improved by applying the soft material 24 to the circumferential surface 23 of the rotor 2 as well as to both sides 21 and 22 of the rotor 2.

As is apparent from the above description, in the rotary fluid pump according to the invention, the rotor is fixedly secured to the rotary shaft and axial pre-pressure is imparted to the bearings supporting the rotary shaft. Accordingly, the rotor can never be axially displaced with respect to the pump housing and the clearance of the various components set in the initial assembly, especially the clearances provided by the gaps 42 and 92 between the rotor and the front and rear housings, are not affected by a thrust force or thermal expansion. Accordingly, the pump is free from problems such as thermal seizure. That is, the clearances provided by the gaps 42 and 92 are maintained unchanged. Furthermore, the pump is simple in construction and the assembly thereof is simplified.

In addition, according to the invention, the soft material is applied to the one side of the rotor 52 which is farther from the bearings 5 as a result of which the rotor will never seize against the housing even when thermal expansion occurs and the minimum clearance will always be maintained between the rotor and the housing. The pump is considerably high in pumping efficiency and easy to assemble because it is unnecessary to adjust the clearances.

What is claimed is:

1. A rotary fluid pump comprising:
a rotary shaft;
a front housing;
a center housing;
a rear housing;
a rotor having vanes adapted to be rotated by said rotary shaft in a space defined by said front housing, said center housing and said rear housing, said rotary shaft being rotatably supported at both ends thereof;
bearing means through which said rotary shaft is coupled to said front housing; said bearing means comprising two ball bearings each having inner and outer races; widths, in an axial direction of said rotary shaft, of confronting sides of said inner races being different from widths of confronting sides of said outer races, respectively;
first means for fixedly securing said inner races to said rotary shaft by tightening said inner races from opposite outer sides in the axial direction;
second means for fixedly securing said outer races to said front housing by tightening said outer races from opposite outer sides in said axial direction;
said two ball bearings being tightened by said first and second securing means to prevent axial displacement of said rotor and rotary shaft when a thrust force is applied thereto.

2. The pump as claimed in claim 1 wherein said first and second securing means comprise first and second retainer rings, said inner races of said ball bearings being fixedly secured to said rotary shaft with said first retainer ring which is fitted over said rotary shaft in such a manner that one of said opposite outer sides of said inner races abuts against a stepped portion of said rotary shaft and the other opposite outer side of the inner races abuts against said first retainer ring, and said outer races of said ball bearings are fixedly secured to said front housing with said second retainer ring which is coupled to said front housing in such a manner that one of said opposite outer sides of said outer races abuts against a stepped portion of said front housing and the other opposite outer side of said outer races abuts against said second retainer ring.

3. The pump as claimed in claim 2 further comprising a mechanical seal having a case ring, said case ring abutting said first retainer ring tightening said inner races of said ball bearings but not said second retainer ring tightening said outer races of said ball bearing.

4. The pump as claimed in claim 2 or 3 further comprising a soft material provided on at least the side of said rotor which is farther from said bearing means and an inner surface of said rear housing which confronts said side of said rotor, whereby said rear housing and said rotor are separated by said soft material without a gap therebetween.

5. The pump as claimed in claim 2 or 3 further comprising a soft material provided on one of both sides of said rotor and the circumferential surface of said rotor, wherein at least one of said rotor abutting said front housing and said rear housing through said soft material and said circumferential surface of said rotor abutting an inner surface of said center housing occurs.

6. The pump as claimed in claim 4 wherein said soft material is tetrafluoroethylene, molybdenum disulfide, or a soft metal.

7. The pump as claimed in claim 4 wherein said soft material is tetrafluoroethylene.

8. The pump as claimed in claim 1 wherein said widths of said confronting sides of said inner races is less than said widths of said confronting sides of said outer races.

9. The pump as claimed in claim 1 wherein said widths of said confronting sides of said inner races is greater than said widths of said confronting sides of said outer races.

10. The pump as claimed in claim 2 wherein said first and second retainer rings are press fitted over said rotary shaft and said front housing, respectively.

11. The pump as claimed in claim 2 wherein said first and second retainer rings are screwed over said rotary shaft and said front housing, respectively.

* * * * *